United States Patent [19]

Bergeron

[11] Patent Number: 5,000,709

[45] Date of Patent: Mar. 19, 1991

[54] UNIVERSAL NOSE CONE AND METHOD FOR PROFILING SAME

[76] Inventor: Robert M. Bergeron, Whithers Grove, Derry, N.H. 03038

[21] Appl. No.: 503,221

[22] Filed: Apr. 2, 1990

[51] Int. Cl.[5] ..... B63H 21/26

[52] U.S. Cl. ..... 440/78

[58] Field of Search ..... 440/66, 71, 76, 78, 440/113, 900; 123/195 P

[56] References Cited

U.S. PATENT DOCUMENTS 3,939,795 2/1976 Rocka ..... 440/78

*Primary Examiner*—Sherman Basinger

*Attorney, Agent, or Firm*—Davis, Bujold & Streck

[57] ABSTRACT

A universal nose cone which has a cavity with height, width and depth dimensions to accommodate a plurality of different water craft drive lower housings so that once the nose cone has been suitably profiled a desired one of these lower housings can be adhesively secured to the gear casing for which it was profiled with the edge of the cavity engaging that housing thereby to streamline that lower housing to improve performance of the water craft using that drive housing.

12 Claims, 4 Drawing Sheets

UNIVERSAL NOSE CONE AND METHOD FOR PROFILING SAME

The present invention relates to a method of forming a universal nose cone which can be adapted to the gear case of virtually any water craft propulsion device once suitably profiled.

BACKGROUND OF THE INVENTION

The basic purpose of a nose cone is to streamline the gear case of the propulsion device so as to increase the top speed and improve the handling of the water craft. Typically, the nose cone is provided with a streamlined frontal portion and a recessed rear portion, for accommodating the gear case, which is substantially a mirror image of the gear case to which the nose cone is to be attached. As virtually each brand of propulsion device has a somewhat different gear case design and/or profile, a substantial number of different molds for forming the nose cones have been required in the past. This translates to the significant expense of producing a desired range of nose cones in the prior art.

Wherefore, it is generally an object of the invention to provide a universal shaped nose cone which, once suitably profiled, can be securely affixed to the gear case of virtually any outboard motor and which results in substantially savings in manufacturing costs.

It is a further object of the invention to provide the nose cone which has a substantially deep recessed cavity or area, for accommodating the front portion of the gear case, with very thin sidewalls which allow a smooth transition at the engagement between the nose cone and the gear case and the motor.

These and other objects of the invention will be better understood with the reference to the attached drawings and following description.

SUMMARY OF THE INVENTION

According to the invention there is provided a method of manufacturing a nose cone to fit any desired one of a plurality of different lower housing designs of propulsion devices for a water craft, comprising the steps of forming a nose cone, universal to a plurality of different said lower housing designs, with a substantially conical lower portion, defining an axis, and a vertical portion extending substantially perpendicular to said axis, said nose cone having an exterior surface defining a hydrodynamic contour, and inner and side walls defining a cavity sized and shaped to accommodate a front portion of every one of said different lower housing designs only after suitable profiling, said side walls terminating in a peripheral edge defining an opening to said cavity, and removing material to profile said peripheral edge so that the lower housing of a said desired one of said lower housings is accommodated in said cavity with said profiled peripheral edge engaging said desired one of said lower housings to streamline that lower housing when installed thereon.

According to a second embodiment of the invention there is provided a nose cone, adapted to be profiled to fit any desired one of plurality of different lower housing designs of propulsion devices for a water craft, comprising a lower portion, defining an axis, and a vertical portion extending substantially perpendicular to said axis, said nose cone having an exterior surface, defining a hydrodynamic contour, and inner and side walls defining a cavity sized and shaped to accommodate a front portion of every one said different lower housing designs after suitable profiling of a peripheral edge of said side walls, said peripheral edge defining an opening to said cavity, whereby said profiled nose cone is able to accommodate the lower housing of a said desired one of said lower housings in said cavity with said profiled peripheral edge engaging said desired one of said lower housings to streamline that lower housing when installed thereon.

BRIEF DESCRIPTION OF THE DRAWINGS

The preferred embodiment of the invention will now be described, by way of example, with reference to the accompanying drawings, in which.

Figure 1:
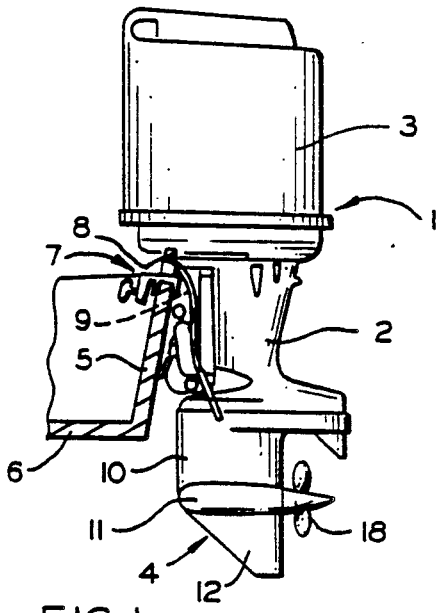
FIG. 1 shows a diagrammatic side elevational view of an outboard motor secured for the stern portion of a watercraft.

Referring now to the FIG. 1, an outboard motor 1 has a drive shaft housing 2 supporting, at the upper end thereof, an engine (not shown) enclosed within a cowl 3 and, at the opposite end thereof, a lower housing 4. The motor 1 is removably secured to the transom 5 of the water craft 6 by means of a bracket assembly 7 which provides for tilting movement of the motor unit in a generally vertical plane, on a generally horizontal tilt pin 8, and steering movement in a generally horizontal plane, on a generally vertical swivel pin 9.

The lower housing 4 includes vertical strut portion 10 adapted at its upper end for securement to the drive shaft housing 2, a gear case 11, beneath the strut portion 10, and a skeg 12 beneath the gear case. A drive shaft (not shown) extends downwardly within the housing 2 and the strut portion 10 and drivingly connects the engine with a generally horizontal propeller shaft (not shown) rotatably disposed in gear case 11 via a pair of meshing bevel gears in the gear case chamber (not shown). The propeller shaft projects rearwardly through an opening in the gear case 11 and carries, rearwardly thereof, a propeller 18 for propelling the watercraft.

Figure 2:
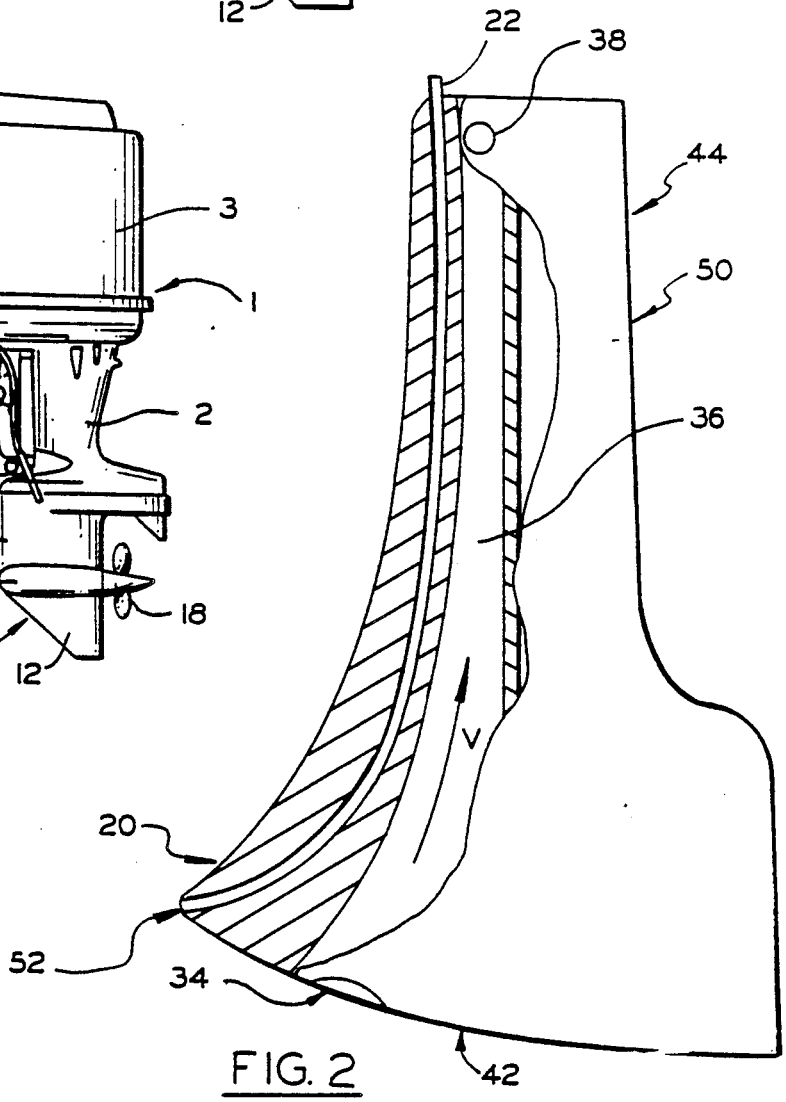
FIG. 2 is a partial cross-sectional view of one form of a nose cone, according to the present invention, having water inlet slots on the bottom portion thereof and a cast in pitot tube.
Figure 4:
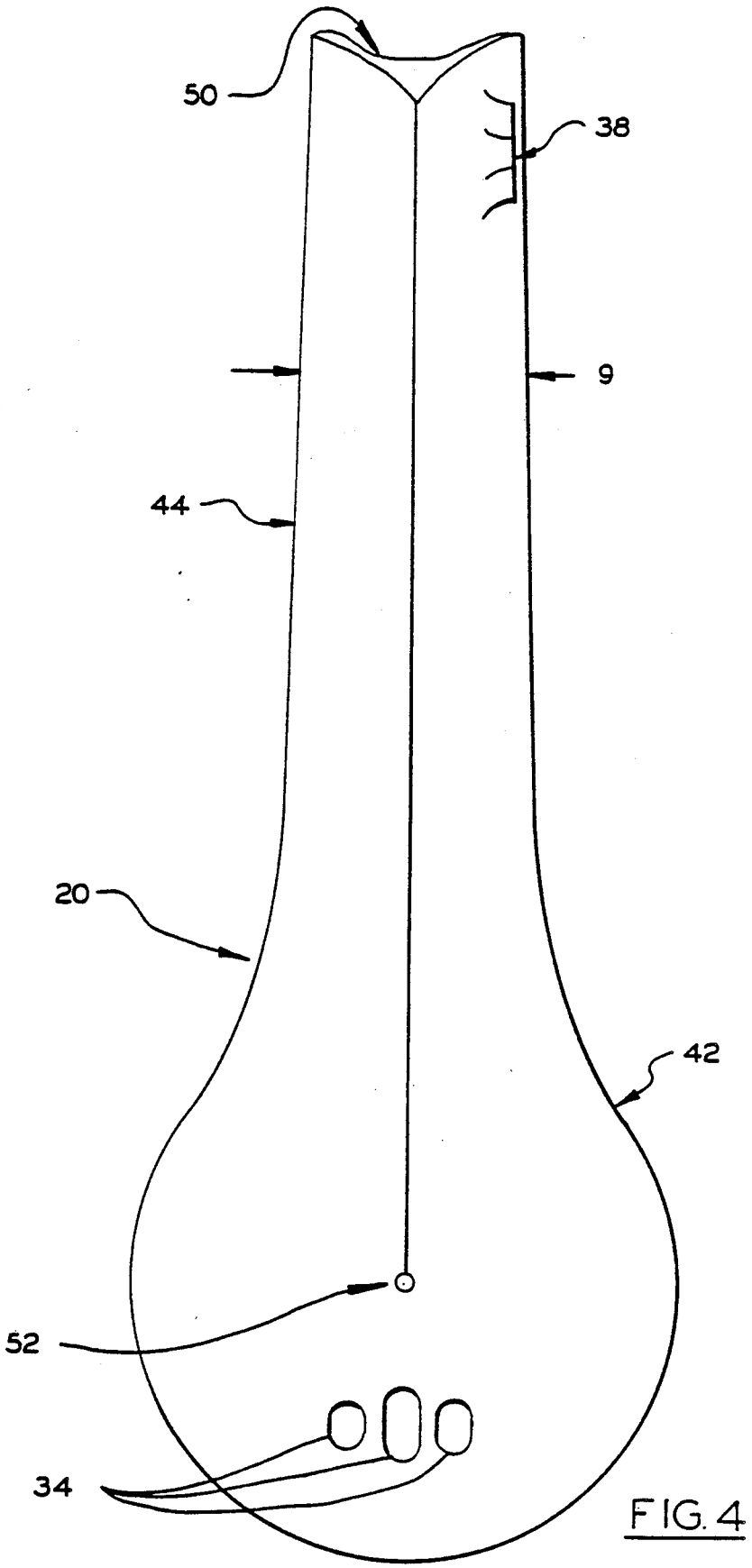
FIG. 4 is a diagrammatic representation of a front elevational view of the nose cone according to the present invention.

Turning now to FIGS. 2 and 4, the basic components of the nose cone of the present invention will now be described in detail. The nose cone 20 is made of cast aluminum, or another castable or moldable material, and may have a pitot tube 22, which serves as a water pressure pickup, cast within the tip portion 52 of the casting. The tubing 22 may be connected to suitable speed sensor means (not shown) to indicate the speed of the water craft as it is propelled over a body of water. Water intake openings 34, are in this embodiment, provided in the lower intermediate portion of the nose cone 20. The intake openings 34 communicate with an outlet opening 38 in the top portion of the nose cone, via passageway 36. During forward travel of the water craft, water enters the nose cone 20, through the intake opening 34, and flows vertically upward through the passageway 36 in the direction of arrow V, and is exhausted out through outlet opening 38. A suitable connection from the engine is made to outlet opening 38 to ensure that the motor 1 is provided with a continuous supply of cooling water even while the water craft is operating at high speeds.

The nose cone comprises a substantially conical portion 42 which tapers to a tip 52 at the forward end thereof. The tip 52 of the nose cone is designed so that it lies substantially on the axis of rotation R of the propeller 18. The nose cone 20 additionally comprises a streamlined vertically extending portion 44 which extends substantially normal to the axis of rotation R. The conical portion 42 and the vertical portion 44 are formed such that their exterior surfaces having a smooth transition from one portion to the other to streamline the hydrodynamic contour of the nose cone 20.

Figure 3:
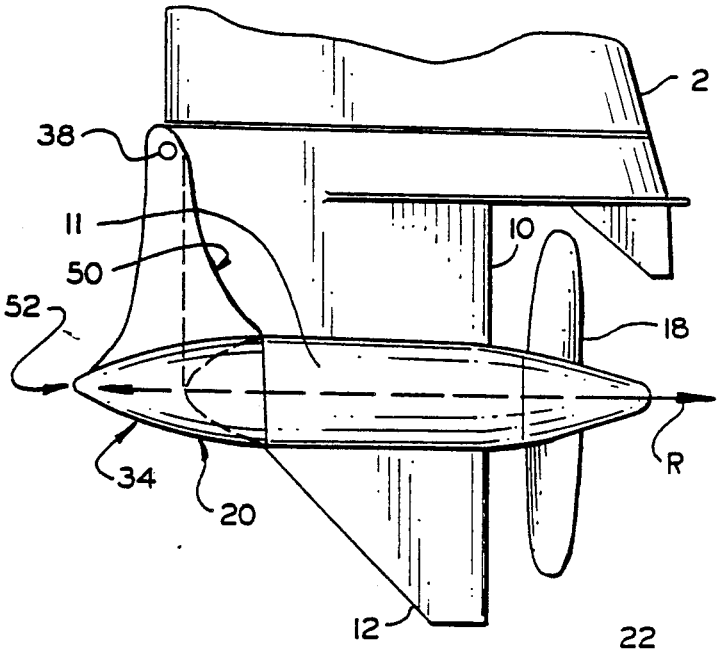
FIG. 3 is a side elevational view showing attachment of a profiled nose cone to the front portion of a motor.

A cavity 50, extending along the entire rearward portion of the nose cone perpendicular to the axis of rotation R, is provided to accommodate a front portion of the gear case and the vertical strut portion, as can be seen in FIG. 3. The cavity 50 has an inner wall 54 (see FIGS. 5 and 6) extending along the entire longitudinal length of the nose cone 20 substantially perpendicular to the axis of rotation R. A rearwardly extending side wall 56, which forms a part of the exterior surface of the nose cone, is connected to the inner wall 54 around the entire perimeter of the cavity 50 except for a top portion thereof (see FIG. 4). The side wall 56 terminates in a peripheral edge 64 which defines an opening to said cavity. The dimensions of the cavity are such that it is deep enough to provide sufficient clearance for a plurality of lower housing (gear case/vertical strut portion) designs. Typical dimensions for the nose cone are d=3½", e=4 1/16", f=11 13/16" and g=1¼", see FIGS. 4, 5 and 6. It is important to note that in order for the nose cone 20 to be a "universal" nose cone, it must have height, width and depth dimensions which allow the nose cone to be snugly secured to virtually any gear casing while still providing ample cavity clearance 60 (see FIG. 6) so that only a sufficient perimeter contact between the side wall 56 and the exterior surface of the gear casing is provided.

The side wall 56 is of a substantially uniform thickness of approximately 5/32". If desired, the entire outer perimeter of the side wall 56 can have an interior chamfer or bevelled edge 58 to smooth the transition between the nose cone and gear casing. It is also anticipated that an exterior chamfer (not shown) may be desirable in some instances.

Figure 5:
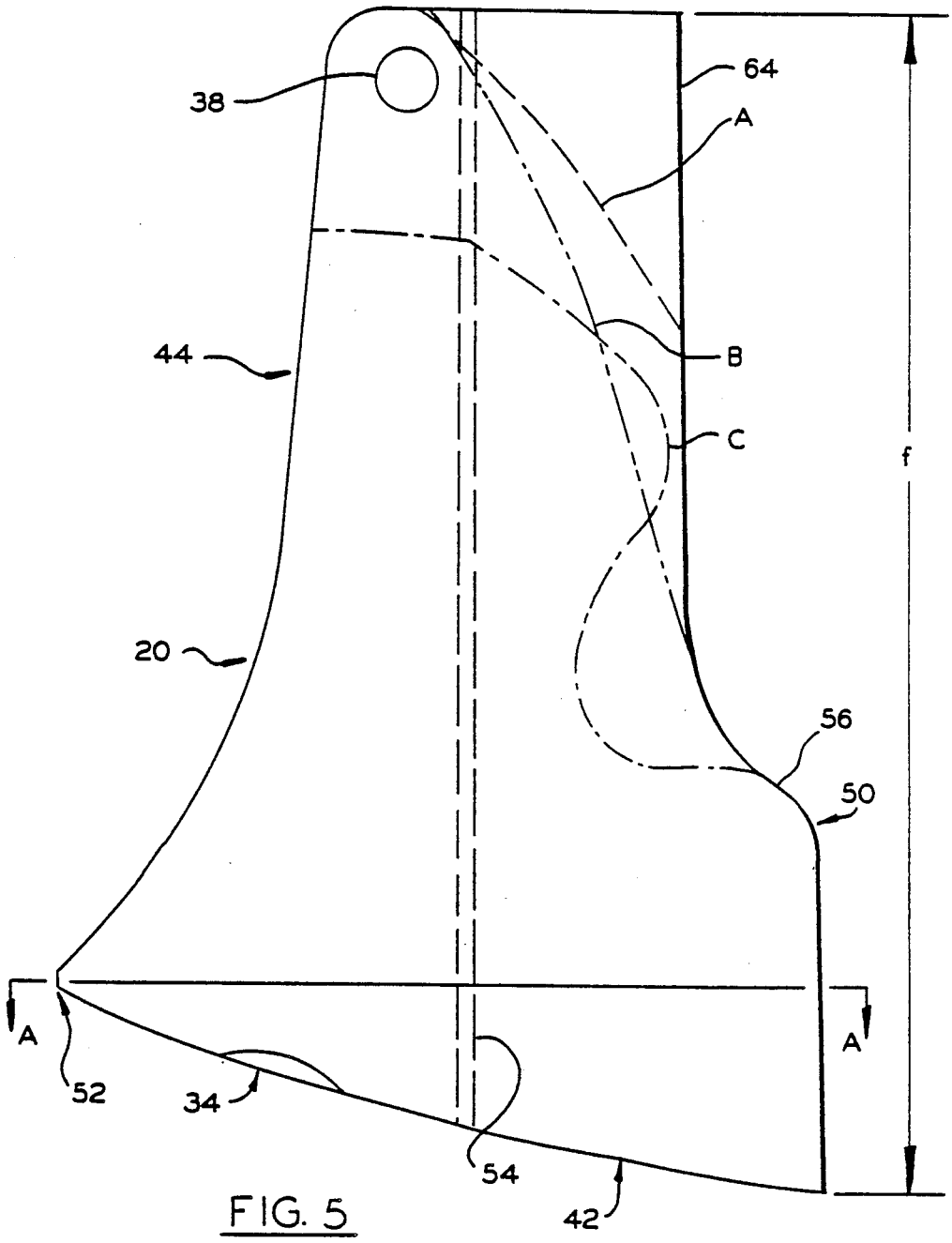
FIG. 5 is a side elevational view of the nose cone of FIG. 4, showing the profiling which is necessary to adapt the nose cone to three different lower housings.
Figure 6:
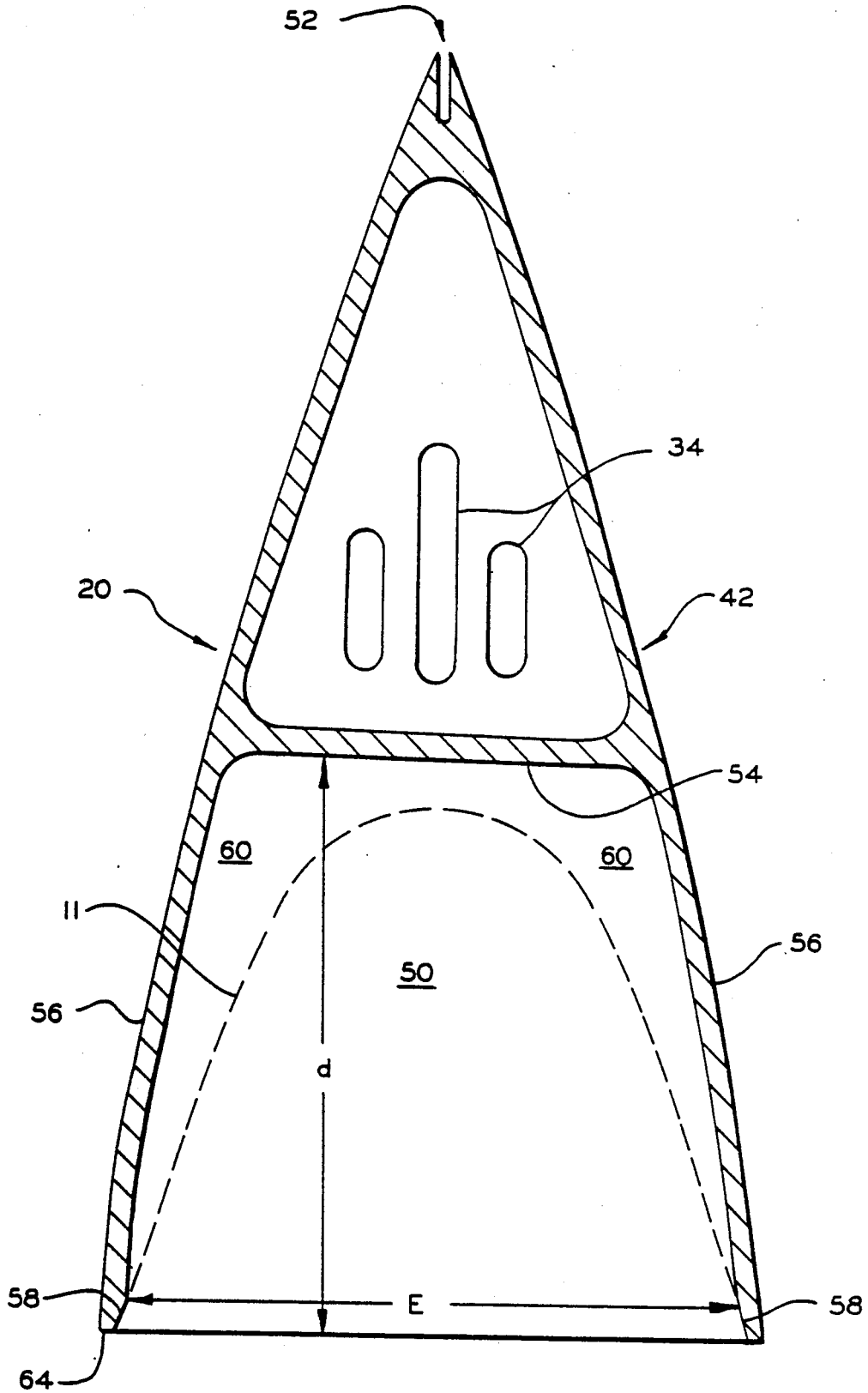
FIG. 6 is a cross-sectional view along section line A—A of FIG. 5.

Turning now to FIG. 5, the three dashed lines A, B and C represent the necessary profiling of the universal nose cone 20 so that it can be secured to a OMC V6, a Mercury V6 and a Bravo V8, respectively. The profiling is achieved by cutting the nose cone 20 along a predetermined contour line A, B or C, for instance. It is to be noted that the amount of profiling necessary for the OMC and the Mercury does not interfere with the water outlet opening 38 so that it may be suitably connected to the engine, after profiling, to ensure that the motor is provided with a continuous supply of water. However, the amount of profiling necessary to adapt the universal nose cone 20 to the gear casing of a Bravo V8, or another similarly shaped gear case, requires that the top portion of the vertical portion 44, including the outlet opening 38, be significantly profiled away. When this occurs, it is necessary to seal off the top portion of the passageway 36 to maintain the hydrodynamic effect of the nose cone. Although the Bravo V8 is not able to utilize the water intake openings 34 of the nose cone 20, this does not present a problem as the Bravo V8 engine is typically low enough on the transom so that the original water intake openings of the engine are fully functional.

The purpose of the profiling is to ensure full perimeter contact between the side wall 56 of the profiled nose cone 20 and the exterior surface of the gear case/vertical strut portion of the motor to be accommodated. Once suitable profiled, the nose cone is secured adhesively, or by other suitable attachment means, to the gear case and the vertical strut portion of a motor (see FIG. 3).

It is to be appreciated that the amount of profiling necessary to adapt the universal nose cone of the present invention to the gear case of a motor is a function of the exterior contour of the desired motor. The term "profiling" is intended to include all types of cutting whether by sawing, machining, laser, cutting torch, etc., to remove a desired part of the vertical portion 44 of the nose cone to adapt it to intimately engage the gear case 11 and strut of the motor.

Since certain changes may be made in the above method for adapting a nose cone to a gear casing without departing from the spirit and scope of the invention herein involved, it is intended that all matter contained in the above desciption and shown in the accompanying drawings shall not be construed as limiting the invention but shall be interpreted as illustrating the invention concept herein involved.

I claim:

1. A method of manufacturing a nose cone to fit any desired one of a plurality of different lower housing designs of propulsion devices for a water craft, comprising the steps of:

(a) forming a nose cone, universal to a plurality of different said lower housing designs, with a substantially conical lower portion, defining an axis, and a vertical portion extending substantially perpendicular to said axis, said nose cone having an exterior surface defining a hydrodynamic contour, and inner and side walls defining a cavity sized and shaped to accommodate a front portion of every one of said different lower housing designs only after suitable profiling, said side walls terminating in a peripheral edge defining an opening to said cavity, and (b) removing material to profile said peripheral edge so that the lower housing of a said desired one of said lower housings is accommodated in said cavity with said profiled peripheral edge engaging said desired one of said lower housings to streamline that lower housing when installed thereon.

2. A method according to claim 1, wherein only sufficient material is removed during profiling to produce said engagement whereby a clearance between said desired one of said lower housings and the inner wall is provided once the nose cone is installed on that lower housing.

3. A method according to claim 1, wherein only sufficient material is removed during profiling to produce said engagement whereby a clearance between said desired one of said lower housings and the side wall remote from the peripheral edge is provided once the nose cone is installed on that lower housing.

4. A method of streamlining a lower housing comprising the step of adhesively securing a profiled nose cone according to claim 1 to a gear casing.

5. A method according to claim 1, further comprising forming said side wall of said nose cone, defining said cavity, of a substantially uniform thickness.

6. A method according to claim 5, wherein said side wall has a thickness of about 5/32 inches.

7. A method according to claim 1, further comprising the steps of casting a pitot tube, for sensing water pressure, in the nose cone.

8. A method according to claim 1, further comprising the steps of:

(a) forming water intake means in said conical portion at a location remote from said vertical portion; and (b) forming outlet means in said vertical portion at location remote from said conical portion with a passageway interconnecting said water intake means and said outlet means.

9. A method according to claim 8, further comprising retaining said outlet means in the vertical portion after profiling.

10. A method according to claim 8, further comprising the steps of:

(a) removing said outlet means during profiling; and (b) sealing the passageway to maintain the hydrodynamic contour of the nose cone.

11. A nose cone, manufactured to fit a desired one of a plurality of different lower housing designs of propulsion devices for a water craft, manufactured by a method comprising the steps of:

(a) forming a nose cone, universal to a plurality of different said lower housing designs, with a substantially conical lower portion, defining an axis, and a vertical portion extending substantially perpendicular to said axis, said nose cone having an exterior surface defining a hydrodynamic contour, and inner and side walls defining a cavity sized and shaped to accommodate a front portion of every one of said different lower housing designs only after suitable profiling, said cavity side walls terminating in a peripheral edge defining an opening to said cavity, and (b) removing material to profile said peripheral edge so that the lower housing of a said desired one of said lower housings is accommodated in said cavity with said profiled perpheral edge engaging said desired one of said lower housings to streamline that lower housing when installed thereon.

12. A nose cone, adapted to be profiled to fit any desired one of a plurality of different lower housing designs of propulsion devices for a water craft, comprising:

a lower portion, defining an axis, and a vertical portion extending substantially perpendicular to said axis, said nose cone having an exterior surface, defining a hydrodynamic contour, and inner and side walls defining a cavity sized and shaped to accommodate a front portion of every one of said different lower housing designs after suitable profiling of a peripheral edge of said side walls, said peripheral edge defining an opening to said cavity, whereby said profiled nose cone is able to accommodate the lower housing of a said desired one of said lower housings in said cavity with said profiled peripheral edge engaging said desired one of said lower housings to streamline that lower housing when installed thereon.

* * * * *